US007657340B2

(12) United States Patent
Lind

(10) Patent No.: US 7,657,340 B2
(45) Date of Patent: Feb. 2, 2010

(54) SYSTEM, APPARATUS AND METHOD FOR FACILITATING PATTERN-BASED CLOTHING DESIGN ACTIVITIES

(75) Inventor: Kathi R. E. Lind, Elgin, IL (US)

(73) Assignee: Dragon & Phoenix Software, Inc., Elgin, IL (US)

( * ) Notice: Subject to any disclaimer, the term of this patent is extended or adjusted under 35 U.S.C. 154(b) by 338 days.

(21) Appl. No.: 11/345,068

(22) Filed: Jan. 31, 2006

(65) Prior Publication Data

US 2007/0198118 A1 Aug. 23, 2007

(51) Int. Cl.
*G06F 19/00* (2006.01)

(52) U.S. Cl. ..... 700/132; 700/130; 700/131; 345/419; 345/630; 705/27

(58) Field of Classification Search ..... 700/86, 700/87, 130, 131, 132, 133; 705/26, 27; 706/919, 920; 345/419, 420, 629, 630; 382/111
See application file for complete search history.

(56) References Cited

U.S. PATENT DOCUMENTS 4,149,246 A 4/1979 Boldman
4,546,434 A 10/1985 Gioello
4,598,376 A 7/1986 Burton et al.
4,899,448 A 2/1990 Huang
4,916,624 A 4/1990 Collins et al.
4,916,634 A 4/1990 Collins et al.
4,926,344 A 5/1990 Collins et al.
4,949,286 A 8/1990 Ohba
5,163,007 A * 11/1992 Slilaty ..... 700/132
5,341,305 A 8/1994 Clarino et al.
5,495,568 A 2/1996 Beavin
5,680,314 A 10/1997 Patterson et al.
5,680,528 A * 10/1997 Korszun ..... 345/630
5,930,769 A * 7/1999 Rose ..... 705/27
6,124,858 A 9/2000 Ge et al.
6,307,568 B1 * 10/2001 Rom ..... 345/629
6,310,627 B1 * 10/2001 Sakaguchi ..... 345/630

(Continued)

FOREIGN PATENT DOCUMENTS

JP 3090607 4/1991

(Continued)

OTHER PUBLICATIONS

"3D Direct: The solution for rapid prototyping," written by Gerber Technology, 2005 on or before December thereof.

(Continued)

*Primary Examiner*—Gary L Welch
*Assistant Examiner*—Nathan E Durham
(74) *Attorney, Agent, or Firm*—K&L Gates LLP

(57) ABSTRACT

A system usable by a processor to enable a user to select a type of garment and view an image of the pattern for the garment. Under direction of the system, the processor enables the user to input data relating to the characteristics of an intended wearer of the garment, and the processor generates a graphical model of the intended wearer. Also, under direction of the system, the processor enables the user to view a simulation of the garment worn on the graphical model. Furthermore, the system changes the pattern image in response to changes the user may make to the garment or the graphical model.

53 Claims, 11 Drawing Sheets

U.S. PATENT DOCUMENTS

| | | | | |
|---|---|---|---|---|
| 6,353,770 | B1 * | 3/2002 | Ramsey et al. | 700/131 |
| 6,404,426 | B1 * | 6/2002 | Weaver | 345/419 |
| 6,415,199 | B1 | 7/2002 | Liebermann | |
| 6,462,740 | B1 * | 10/2002 | Immel | 345/473 |
| 6,473,671 | B1 | 10/2002 | Yan | |
| 6,516,240 | B2 * | 2/2003 | Ramsey et al. | 700/131 |
| 6,546,309 | B1 * | 4/2003 | Gazzuolo | 700/132 |
| 6,564,118 | B1 | 5/2003 | Swab | |
| 6,700,578 | B2 | 3/2004 | Kamata et al. | |
| 6,701,207 | B1 | 3/2004 | Gazzuolo | |
| 6,711,455 | B1 | 3/2004 | Holloway et al. | |
| 6,724,383 | B1 | 4/2004 | Herken et al. | |
| 6,725,124 | B2 | 4/2004 | Yan | |
| 6,882,897 | B1 | 4/2005 | Fernandez | |
| 6,901,379 | B1 * | 5/2005 | Balter et al. | 705/27 |
| 6,907,310 | B2 | 6/2005 | Gardner et al. | |
| 6,968,075 | B1 * | 11/2005 | Chang | 382/111 |
| 7,079,134 | B2 * | 7/2006 | Kung et al. | 345/420 |
| 2001/0026272 | A1 * | 10/2001 | Feld et al. | 345/419 |
| 2002/0103566 | A1 * | 8/2002 | Gadson | 700/132 |
| 2002/0138170 | A1 * | 9/2002 | Onyshkevych et al. | 700/130 |
| 2003/0011590 | A1 * | 1/2003 | Kung et al. | 345/419 |
| 2003/0074099 | A1 | 4/2003 | Yan | |
| 2003/0204564 | A1 | 10/2003 | Keene | |
| 2004/0049309 | A1 | 3/2004 | Gardner et al. | |
| 2004/0078285 | A1 * | 4/2004 | Bijvoet | 705/26 |
| 2004/0153195 | A1 | 8/2004 | Watanabe | |
| 2004/0158345 | A1 | 8/2004 | Watanabe | |
| 2004/0186611 | A1 | 9/2004 | Wang | |
| 2004/0189667 | A1 | 9/2004 | Beda et al. | |
| 2004/0236455 | A1 | 11/2004 | Woltman et al. | |
| 2004/0236456 | A1 | 11/2004 | Pieper et al. | |
| 2004/0236457 | A1 | 11/2004 | Stabelfeldt et al. | |
| 2005/0131571 | A1 | 6/2005 | Costin | |
| 2005/0154487 | A1 | 7/2005 | Wang | |
| 2005/0283267 | A1 | 12/2005 | Bingham et al. | |
| 2006/0015208 | A1 * | 1/2006 | Reyes Moreno | 700/132 |

FOREIGN PATENT DOCUMENTS

| | | |
|---|---|---|
| JP | 31556684 | 7/1991 |
| JP | 11203347 | 7/1999 |
| JP | 11286817 | 10/1999 |
| JP | 2001222568 | 8/2001 |
| JP | 2004100063 | 4/2004 |

OTHER PUBLICATIONS

"About V-Stitcher, Envision True-to-Life Garment Modeling" [online] [retrieved from the Internet Jan. 30, 2006] <URL: http://www.browzwear.com/index.asp>.

"Automatic Modeling of Virtual Humans and Body Clothing" by Nadia Magnenat-Thalmann, Hyewon Seo and Frederic Crodier, prior to Jan. 31, 2006.

"Bodynits of Singapore Uses Browzwear's V-Stitcher to solve fit issues and presenting Virtual samples to its buyers," Jan. 2005 [online] [retrieved from the Internet Jan. 30, 2006] <URL: http://www.browzwear.com/news.asp>.

"BodyScanner—Body Measurement," [online] [retrieved from the Internet Jan. 30, 2006] <URL: http://www.lectra.com/en/lib/php/print.php?p_url=http://www.lectra.com/en/fashion_appar...>.

"Browzwear to launch a new on line fashion and community game—Stylezone," Dec. 1, 2005, [online] [retrieved from the Internet Jan. 30, 2006] <URL: http://www.browzwear.com/index.asp>.

Clothing, The World Book Encyclopedia, vol. 4, 2001, on or before December thereof, p. 706.

"Cranky Consumer: Finding the Perfect Pair of Jeans—On the Internet," by Christina S.N. Lewis and Jessica E. Vascellaro, The Wall Street Journal Online, Jan. 19, 2006 [online] [retrieved from the Internet Jan. 20, 2006] <URL: http://online.wsj.com/article_email/article_print/SB113762924530050250-1MyQjAxMDE2MzI3...>.

DSC 2003 Working Papers (Draft Versions): "A Framework for an R to OpengL Interface for Interactive 3D graphics" by Daniel Adler and Oleg Nenadić, 2003 on or before December thereof.

"Faster prototyping," [online] [retrieved from the Internet Jan. 30, 2006] <URL: http://www.lectra.com/en/lib/php/print.php?p_url=http://www.lectra.com/en/fashion_appar...>.

"Gerber Technology: Gerber 3D Direct Your ticket to rapid prototyping," Internet Demonstration [online] [retrieved from the Internet Jan. 3, 2006] <URL: http://www.gerbertechnology.com/gtwww/flash/3D-direct/3DDirectDemo.swf>.

"Haute Couture 3D," [online] [retrieved from the Internet Jan. 30, 2006] <URL: http://www.padsystem.com/en/Software_HC3D.html>.

Illustration of padsystem [online] [retrieved from the Internet Jan. 30, 2006] <URL: http://www.padsystem.com/img/SEWING.gif>.

"Interactive Deformable Models to Create Chairs" by Aseem Agarwala, prior to Jan. 31, 2006.

"Made-to-Measure Technologies for an Online Clothing Store" by Frederic Cordier, Hyewon Seo and Nadia Magnenat-Thalmann, published by IEEE Computer Society, Jan./Feb. 2003.

"Ocean Sky Uses Browzwear's V-Stitcher to Share Design Ideas Virtually and Reduce Product Development Cycle Time," Aug. 2004 [online] [retrieved from the Internet Jan. 30, 2006] <URL: http://www.browzwear.com/news.asp>.

"PatternMaker Sewing projects: Women's panties," [online] [retrieved from the Internet prior to Jan. 31, 2006] <URL: http://www.leenas.com>.

"Raster and Vector Spatial Data Models," [online] [retrieved from the Internet Jan. 23, 2006] <URL: http://uwadmnweb.uwyo.edu/anthropology/faculty/GeorgeGill.htg/gis/Raster%20vs.%20Vector.htm>.

"Shapely Shadow—FastFit™ Software, The Real solution for the True Garment," [online] [retrieved from the Internet Jan. 30, 2006] <URL: http://shapelyshadow.com/_main/Index.cfm?page+api/360gv.cfm&pageTitle+Shapely%20Shadow%20>.

"Shapely Shadow—RealForms™, Fit on Skin," [online] [retrieved from the Internet Jan. 30, 2006] <URL: http://shapelyshadow.com/_main/Index.cfm?page+api/real.cfm &pageTitle+Shapely%20Shadow%20-%2...>.

"Shapely Shadow—Symmetrical Dressforms and Clones of the Elite . . . ," 2006 Shapely Shadow, Inc., [online] [retrieved from the Internet Jan. 30, 2006] <URL: http://shapelyshadow.com/_main/Index.cfm>.

"StyleZone, the Online Fashion Community" [online] [retrieved from the Internet Jan. 30, 2006] <URL: http://www.stylezone.com/cs/SZDownloadMe/SZComingSoon.aspx>.

"SyFlex—Advanced Cloth Simulation", [online] [retrieved from the Internet Jan. 30, 2006] <URL: http://www.ilumina.ca/sy.htm>.

"SyFlex—The Cloth Simulator," [online] [retrieved from the Internet Jan. 30, 2006] <URL: http://www.syflex.biz/index.html>.

"SyFlex—The Cloth Simulator," [online] [retrieved from the Internet Jan. 30, 2006] <URL: http://www.syflex.biz/features.html>.

"Vector graphics" [online] [retrieved from the Internet Jan. 24, 2006] <URL: http://en.wikipedia.org/wiki/Vector_graphics>.

"Vector Data Model," [online] [retrieved from the Internet Jan. 23, 2006] <URL: http://www.gis.com/implementing_gis/data/vector.html>.

"Virtual Clothes, Hair and Skin for Beautiful Top Models" by Nadia Magnenat Thalmann, Stephane Carion, Martin Courchesne, Pascal Volino and Yin Wu, MIRALab Copyright © Information 1998 on or before December thereof.

"Wild Ginger PatternMaster v.3," [online] [retrieved from the Internet Jan. 30, 2006] <URL: http://www.wildginger.com/products/patternmaster.htm>.

(Anderson). "Patternmaking Past to Present" [online], Sep. 2005 [Retrieved on Aug. 22, 2007]. Retrieved from the Internet: <http://www.techexchange.com/thelibrary/patternmaking.html>.

"Optitex Marker Making". Textile Productivity Features [online]. Optitex, Jan. 12, 2006 [retrieved on Aug. 22, 2007]/ Retrieved from the Internet: <http://webarchive.org/web/20060112164935/http://optitex.com/en/Products/Marker_Making>.

* cited by examiner

SYSTEM, APPARATUS AND METHOD FOR FACILITATING PATTERN-BASED CLOTHING DESIGN ACTIVITIES

BACKGROUND

Apparel manufacturers, home sewers and other clothing makers typically make garments based on patterns. The pattern determines the size and shape of the garment. It is common for the clothing makers to refer to a pattern book to select their patterns. Each pattern in the book corresponds to a particular type of garment and a particular range of body measurements. Knowing the wearer's garment preference and body measurements, the clothing maker can select one of the patterns.

One disadvantage with this process is that it can exclude a significant degree of a person's uniqueness. For example, some people have hour glass-shaped torsos or rectangular-shaped torsos, while others have upwardly pointing triangular-shaped torsos or downwardly pointed triangular-shaped torsos. The range-based pattern selection process can exclude these unique factors from the garment design process.

To provide a better fit, garment makers sometimes manually alter the patterns. Other times, the wearers have their garments tailored to obtain a better fit. The process of altering patterns and obtaining tailoring services can be inconvenient, time consuming and relatively expensive. Consequently, many people skip these steps and choose to wear clothes with a fit that is inadequate or is only moderately complimentary to their unique shapes and sizes.

There is a need to overcome the disadvantages described above. There is also a need to provide improvements applicable to pattern-based design activities.

SUMMARY

The pattern-based design system, in one embodiment, generally relates to a computerized system involving clothing or garment design and the production of customized patterns for the designed garment. The system can be used by clothing designers or manufacturers, including, without limitation, apparel design professionals, professional or hobby sewers, fashion designers and others involved in the clothing industry. The clothing design system can be used to design clothing for different types of wearers, including, without limitation, humans (adults and children), animals and pets, such as dogs and cats. For the case where the intended wearer is a human, the user of the system 10 can be the intended wearer.

In one embodiment, the clothing design system enables the user to: (a) select a desired garment; (b) view a pattern layout for the garment; (c) build a graphical model of the intended wearer based upon body characteristics input by the user; (d) view a simulation of the garment being worn on the graphical model; (e) make adjustments to the garment, the ease and fit of the garment or the size or shape of the graphical model; (f) automatically view an update of the pattern layout and measurement window based upon changes made in the garment or graphical model; and (g) print the pattern necessary to make the garment. This type of system provides users with enhanced convenience, efficiency and customization in designing garments and obtaining customized garment patterns.

The clothing design system has a plurality of technical effects or technical contributions. One such contribution is the reduction in data storage needs through use of vector-based graphical modeling in computerized clothing design. Another such contribution is the reduction in the amount of computer code or programming code which is necessary to generate models, where the models represent the bodies of intended wearers and the clothes they are wearing in a virtual environment. This reduction is programming code can be attributed to the use of multiple element layers in vector-based graphical modeling, as described further below.

Additional features and advantages are described herein, and will be apparent from, the following Detailed Description and the figures.

DETAILED DESCRIPTION

Figure 1:
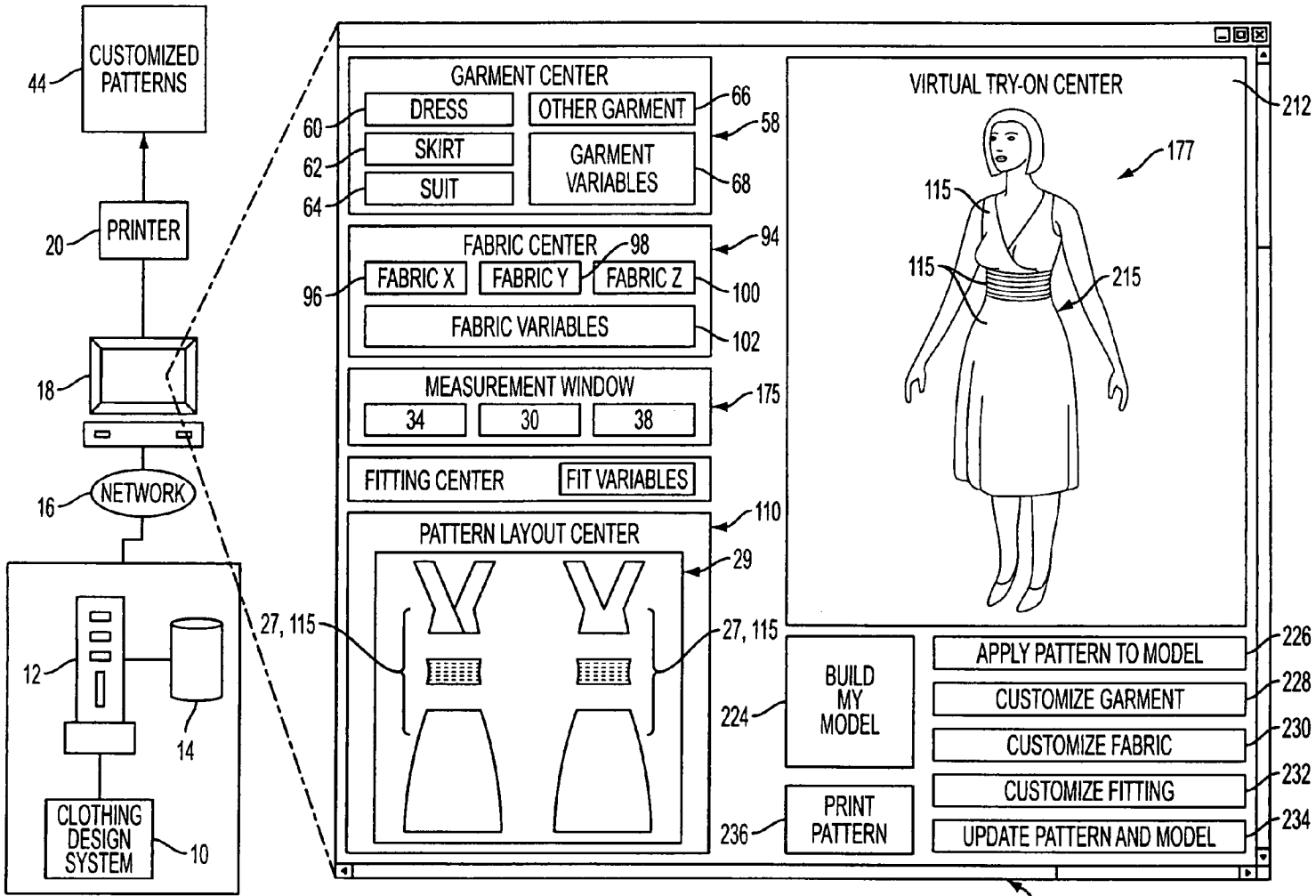
FIG. 1 is a diagrammatic view of one embodiment of the clothing design system, server, database, network, computer, printer, customized patterns and graphical user interface.
Figure 2:
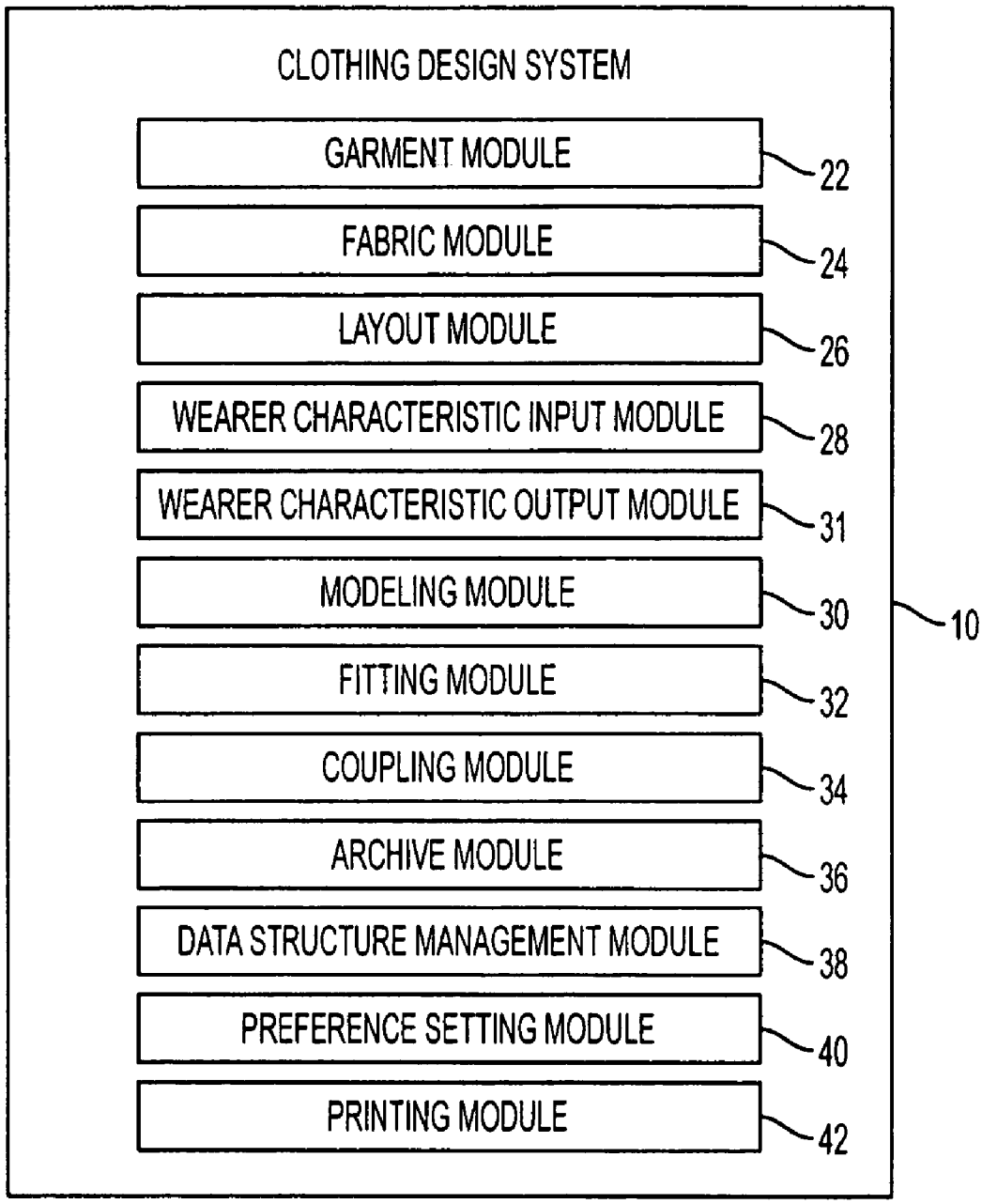
FIG. 2 is a schematic block diagram illustrating the modules of one embodiment of the clothing design system.

Referring now to the drawings, FIG. 1 illustrates one embodiment of the clothing design system 10. The clothing design system 10 includes a plurality of computer readable instructions which are accessible by one or more processors or servers 12. In one embodiment, the system 10 includes a plurality of programming modules which control the operation of the server 12. Each module includes a set of computer-readable instructions and data which are related to a designated function, purpose, subject matter or topic. This type of modular construction of the clothing design system 10 can be created using any suitable computer programming language or database, including, without limitation, JAVA, C++ or SQL for specifying business logic and other functions. In another embodiment, the clothing design system 10 is structured as a single module or single set of computer-readable instructions. In such case, this single set of computer-readable instructions has the functionality of the clothing design system's separate modules which are described in detail below.

The server 12 is coupled to one or more data storage devices or databases 14. The database 14 stores pre-stored data which is accessed or retrieved by the server 12, including, without limitation, one or more catalogs of garment data, one or more catalogs of fabric data, theoretical model data (described below) and default fitting data. Also, the database 14 stores the data input by the user for processing and future retrieval by the user.

In addition to being coupled to the database 14, the server 12 is coupled to an electronic network or a data network 16, such as a local area network, wide area network, public network or any portion of the Internet. This enables the user to access the system 10 anywhere the network 16 is accessible. In the example illustrated, one or more network access devices 18, such as a personal computer, is coupled to the network 16. It should be appreciated that the network access device 18 can include a standard desktop computer, a standard laptop computer, a personal digital assistant, a mobile phone with data processing capabilities or any other suitable network-enabled, computerized apparatus. The network access device 18 is coupled to one or more printers 20 which are operable to print text and images on paper.

Referring to FIGS. 1 through 7, the clothing design system 10, in one embodiment, includes: (a) a garment module 22 which enables the user to select desired garment factors or parameters; (b) a fabric module 24 which enables the user to select desired fabric factors or parameters; (c) a layout module 26 which is used by server 12 to cause the computer 18 to display a two-dimensional pattern image 27 of the selected garment's pattern, and the pattern image 27 is displayed so as to overlay a two-dimensional fabric image 29 of the selected fabric; (d) a wearer characteristic input module 28 which enables the user to input a plurality of characteristics of the intended wearer of the selected garment; (e) a wearer characteristic output module 31 which causes the computer 18 to indicate to the user, the characteristic data input by the user; (f) a modeling module 30 which causes the server 12 to produce a three-dimensional graphical representation or model of the intended wearer who is trying-on the selected garment in a virtual environment; (g) a fitting module 32 which enables the user to adjust a plurality of fitting parameters or ease and fit settings while the selected garment is shown on the graphical model of the intended wearer; (h) a coupling module 34 which operatively couples the layout module 26 to the modeling module 30 and the wearer characteristic output module 31, as described in detail below; (i) an archive module 36 which enables the user to save and store desired files, images, settings and other data, as described further below; (j) a data structure management module 38 which enables the server 12 to manage the data which is input by the user as well as the data which is pre-stored in the database 14; (k) a preference setting module 40 which enables the user to set a plurality of settings or configurable parameters used to control the function and visual output of the clothing design system 10, as described further below; and (l) a printing module 42 which enables the server 12 to cause the printer 20 to print customized patterns 44, as described further below.

Figure 3:
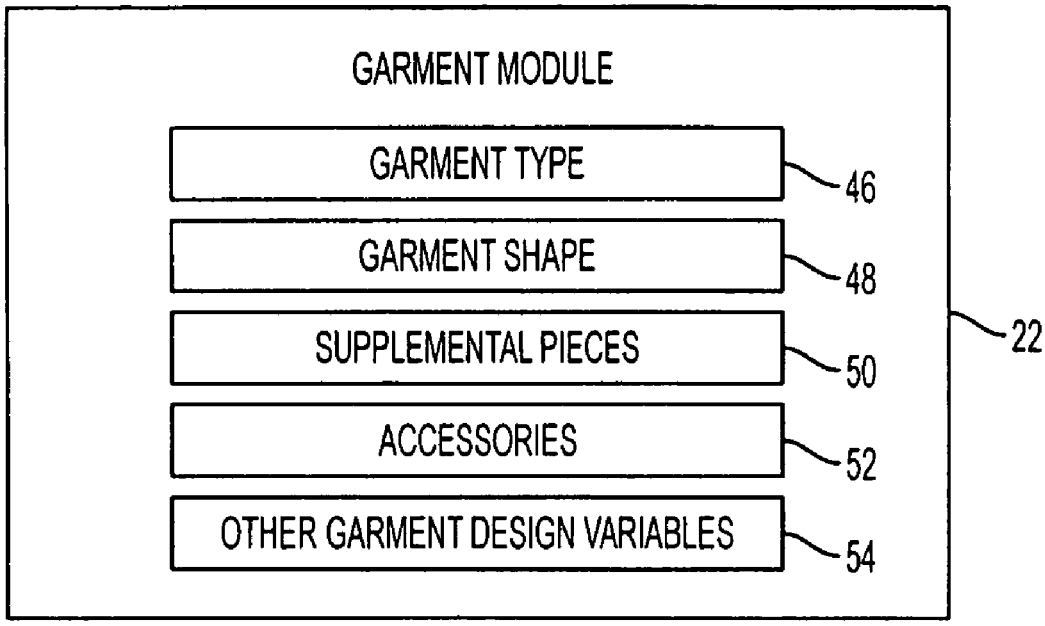
FIG. 3 a schematic block diagram illustrating the modules and functionality of the garment module of one embodiment of the clothing design system.

As best illustrated in FIG. 3, the garment module 22 enables the user to select the desired garment based upon a plurality of factors, including: (a) the garment type 46; (b) the garment shape 48; (c) supplemental pieces 50 which can be optionally added to the selected garment; (d) accessories 52 which can be optionally added to, or used in conjunction with, the selected garment; and (e) other suitable garment design variables 54.

In the example illustrated in FIG. 1, the clothing design system 10 causes the computer 18 to display a main graphical interface or main window 56. In this example, the garment center 58, controlled by the garment module 22, enables the user to input a selection from a category of dress 60, skirt 62, suit 64 or another type of garment 66. The garment center 58 also enables the user to select a plurality of other garment variables 68.

Figure 4:
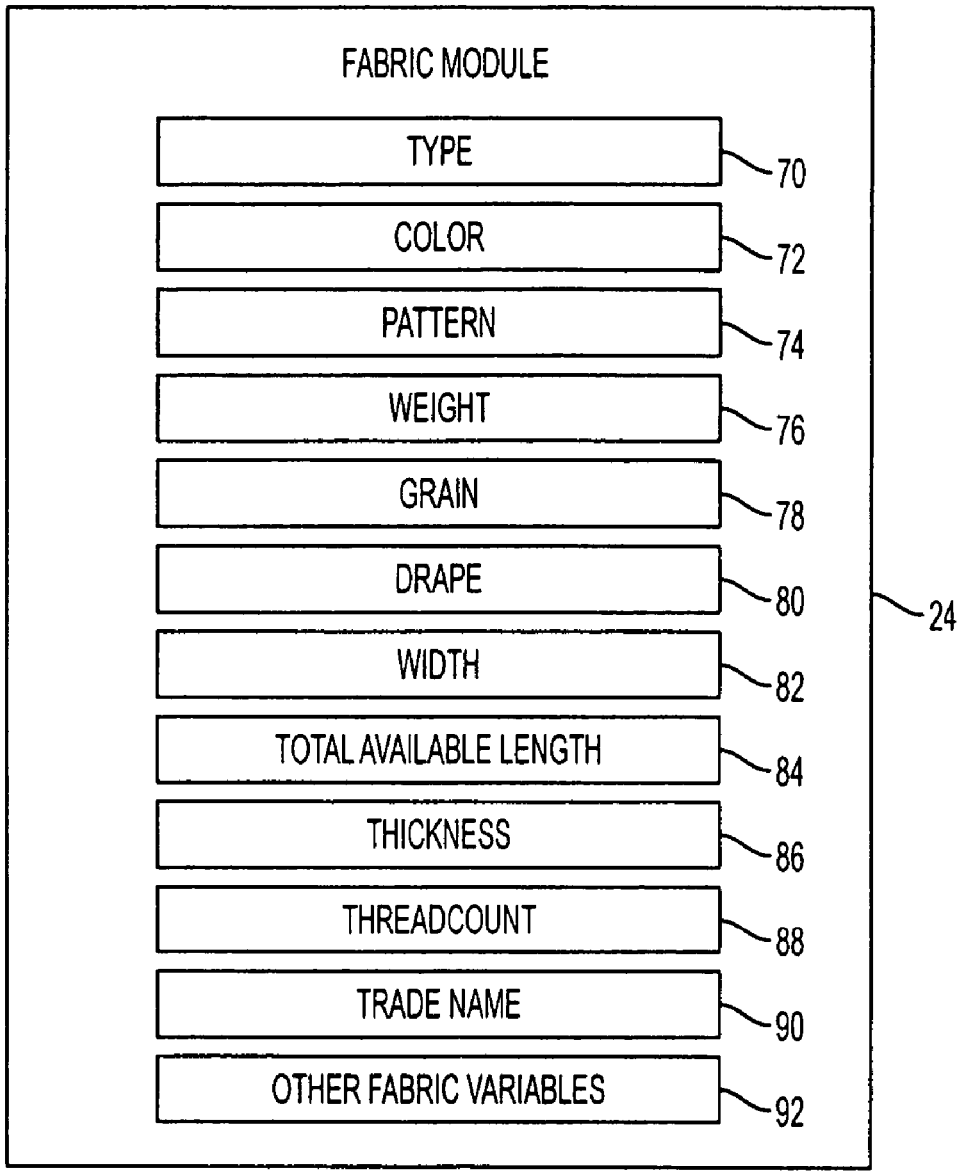
FIG. 4 a schematic block diagram illustrating the modules and functionality of the fabric module of one embodiment of the clothing design system.

Referring to FIG. 4, the fabric module 24, in one embodiment, enables the user to select the desired fabric by type 70, color 72, pattern 74, weight 76, grain 78, grade 80, width 82, total available length 84, thickness 86, thread count 88, trade name 90 and other suitable fabric variables 92. Referring back to FIG. 1, in one example, the fabric module 24 causes the server 12 to display a fabric center 94. In this example, the fabric center 94 enables the user to select fabric X 96, fabric Y 98 or fabric Z 100. The fabric center 94 also enables the user to select a plurality of additional suitable fabric variables 102.

Figure 5:
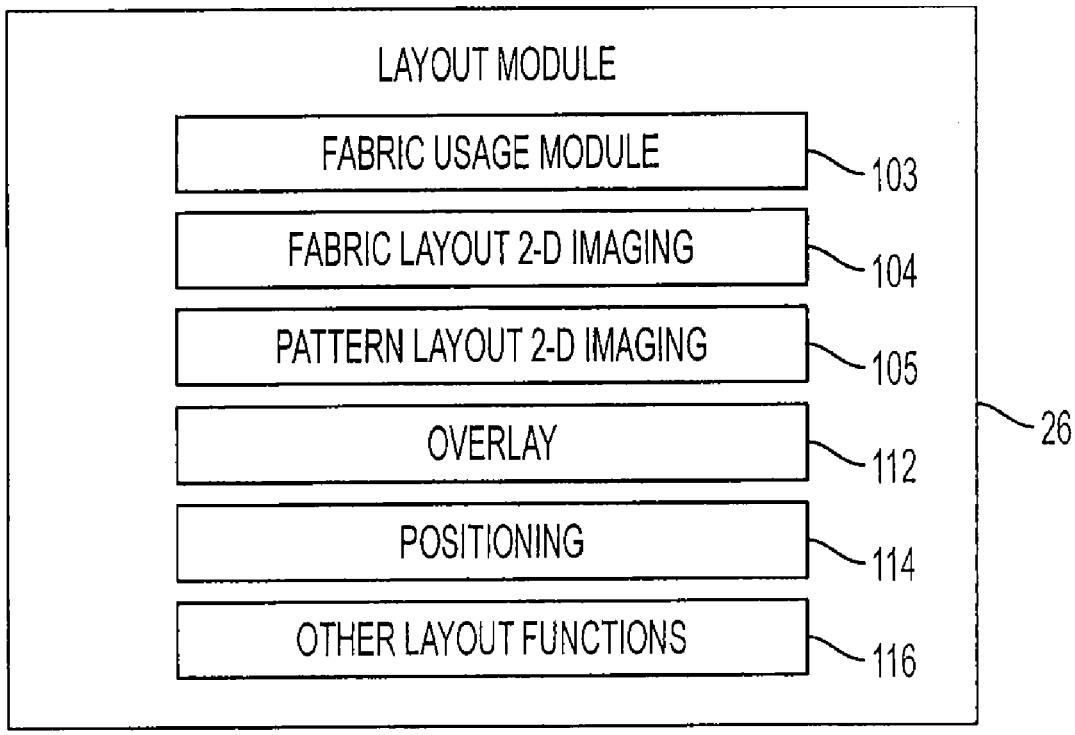
FIG. 5 a schematic block diagram illustrating the modules and functionality of the layout module of one embodiment of the clothing design system.

Referring to FIG. 5, the layout module 26, in one embodiment, includes: (a) a fabric usage optimizer module or fabric usage module 103 which enables the computer 18 to automatically select a width and length dimension for a fabric piece sized at least as large as the pattern in laid-out form, wherein the selected width and length dimension reduces portions of the fabric piece which will be unused in constructing the garment; (b) a fabric layout 2-D imaging module 104 which enables the computer 18 to display the two-dimensional fabric image 29 as if the selected fabric were laid out on a table; (c) a pattern layout 2-D imaging module 108 which enables the computer 18 to display the two-dimensional pattern image 27 within the pattern layout center 110; (d) an overlay module 112 which is used by the server 12 to cause the computer 18 to visually lay the pattern image 27 on top of the fabric image 29; (e) a positioning module 114 which enables the server 12 to cause the pattern image 27 to be positioned or repositioned relative to the fabric image 29 based upon an automatic positioning process or based upon inputs made by the user; and (f) a plurality of other suitable layout functions 116 which cause the computer 18 to provide suitable visual outputs within the layout center 110 based upon an automatic process or inputs made by the user.

In one alternative embodiment, the fabric layout module 104 can, in one embodiment, display the fabric image 29 in a three-dimensional form. For example, an edge of the fabric can be illustrated with an edge image to illustrate the thickness of the fabric. It should be understood that the pattern layout module 104 can graphically represent the pattern corresponding to the selected garment by displaying a black or colored line, in solid or dotted form, which outlines the shape of such pattern. Alternatively, the pattern layout module 104 can display the pattern as a solid or filled-in image, in two-dimensional or three-dimensional form. In the example illustrated in FIG. 1, the selected garment is a ruched-waist dress which includes an assembly of six garment pieces displayed as six garment piece images 115. Accordingly, the pattern image 27 specifies the shape of this garment with a solid line outlining the six garment pieces.

Figure 6:
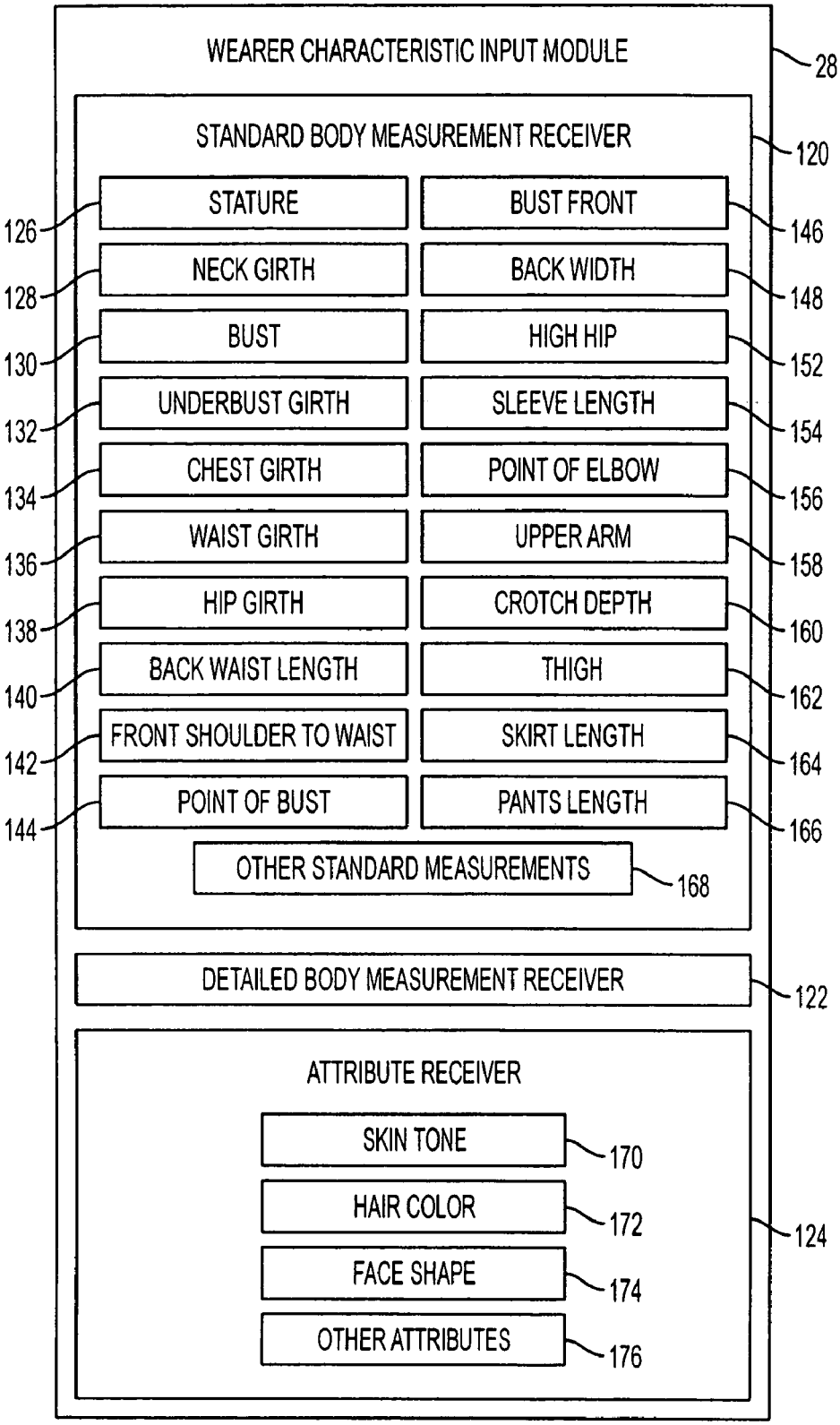
FIG. 6 a schematic block diagram illustrating the modules and functionality of the wearer characteristic input module of one embodiment of the clothing design system.

Referring now to FIG. 6, the wearer characteristic input module 28, in one embodiment, includes: (a) a standard body measurement receiver 120 which enables the user to input a plurality of body measurements relating to the intended wearer; (b) a detailed body measurement receiver 122 which enables the user to input a plurality of body measurements, beyond what might be considered to be industry standard measurements; and (c) an attribute receiver 124 which enables the user to input a plurality of attributes of the intended wearer, where the attributes are not necessarily measurable by dimensions. The wearer characteristic input module 28 enables the user to enter or input the data through use of a keyboard, touch screen, microphone or other suitable input device.

The measurements receivable by the standard body measurement receiver 120 can be determined by any suitable industry standard, including, without limitation, the standards set by ASTM International, a standards development organization originally known as the American Society for Testing and Materials. In the example illustrated in FIG. 6, the standard body measurement receiver 120 enables the user to input the following measurements of the intended wearer: stature 126, neck girth 128, bust 130, under bust girth 132, chest girth 134, waist girth 136, hip girth 138, back waist length 140, front shoulder to waist 142, point of bust 144, bust front 146, back width 148, high hip 150, sleeve length 152, point of elbow 156, upper arm 158, crotch depth 160, thigh 162, skirt length 164, pants length 166 and other suitable standard measurements 168.

The detailed body measurement receiver 122 enables the user to input measurements of the intended wearer which specify or describe the wearer's size or shape at points of the body which lie between the measurement points of the standard body measurement receiver 120. For example, the detailed body measurement receiver 122 may enable the user to input the user's torso circumference at a height of seven inches above the crotch, at another height of seven and one-half inches above the crotch, at another height of eight inches above the crotch, at another height of eight and one-half inches above the crotch, and at another height of nine inches above the crotch. The detailed body measurement receiver 122 can enable the user to input these types of measurements for the user's entire torso, legs, arms, neck and entire body. As described further below, the system 10 uses this detailed input data to generate a relatively detailed map or model of the topology of the intended wearer's body.

With continued reference to FIG. 6, the attribute receiver 124 enables the user to input the attributes of the intended wearer which may or may not be measurable in terms of dimensions or magnitude. For example, the attribute receiver 124 can enable the user to input data corresponding to the intended wearer's skin tone 170, hair color 172, general face shape 174 and other suitable attributes 176.

Figure 10:
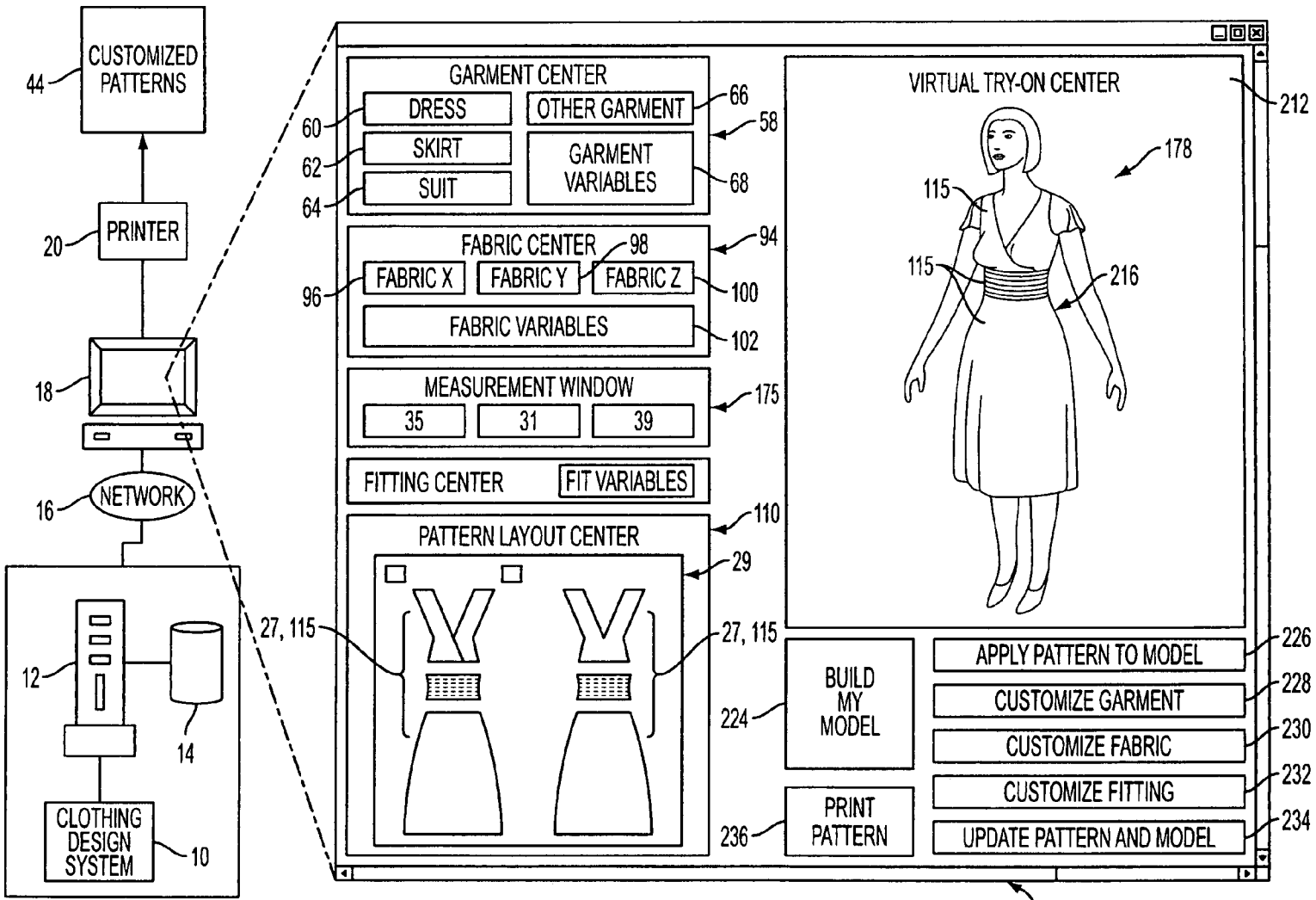
FIG. 10 is a top plan view of a graphical user interface of one embodiment of the clothing design system, illustrating an example in which the pattern layout and measurement window is automatically updated when the user: (a) adds shoulder garment pieces to the garment worn on the generated model; and (b) changes certain measurements associated with the intended wearer.

After the server 12 receives the wearer's data input through the wearer characteristic input module 28, the wearer characteristic output module 29 enables this data to be viewed by the user. The wearer characteristic output module 29, in one embodiment, causes the computer 18 to display a measurement window, image or characteristic window 175, as illustrated in FIGS. 1 and 10. The characteristic window 175 displays or graphically indicates the measurements and other characteristic data which is input by the user. In one embodiment, the characteristic window 175 displays the inches or centimeters of the girths, widths, lengths and other measurements received by the wearer characteristic input module 28.

Figure 7:
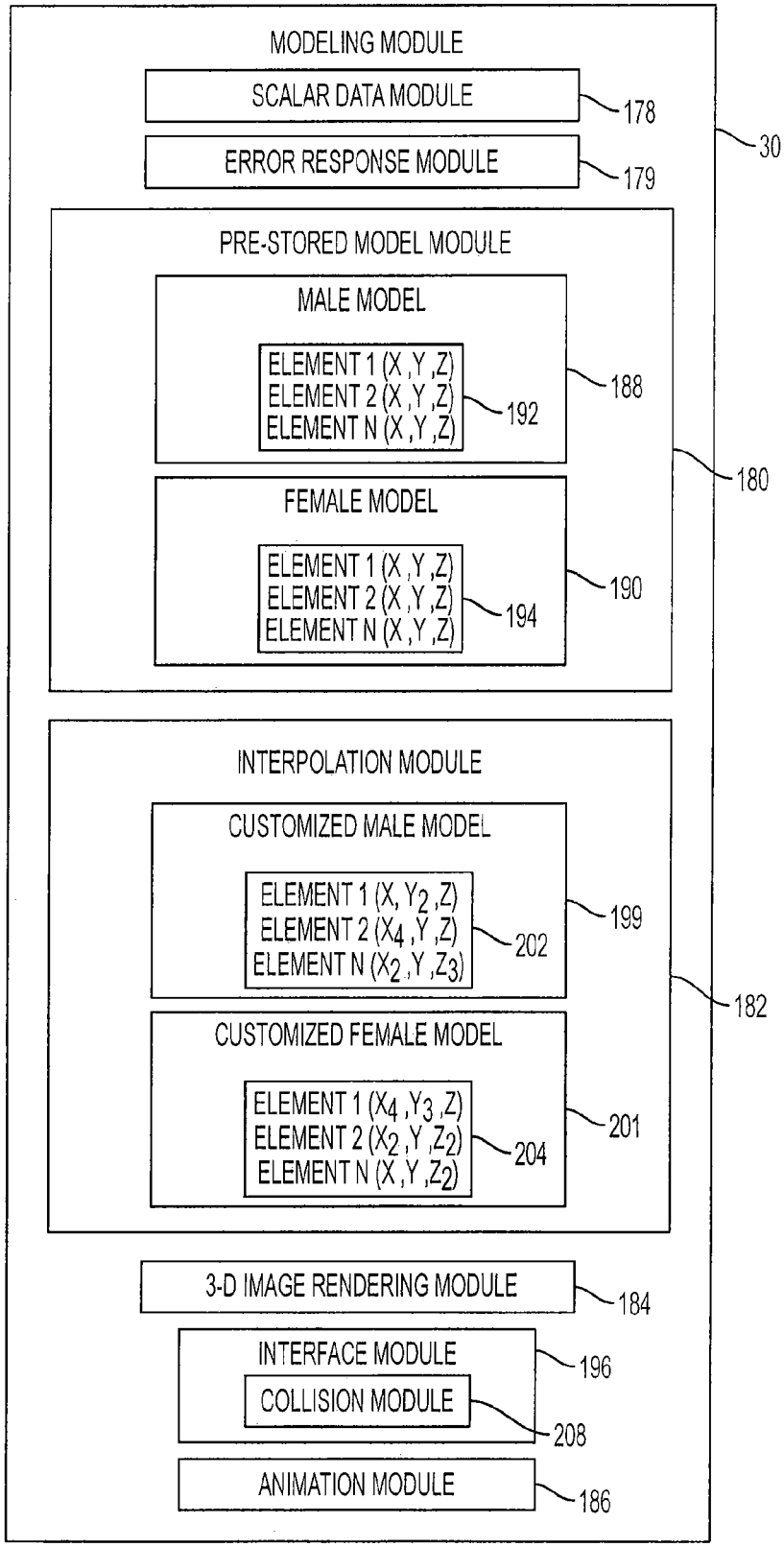
FIG. 7 a schematic block diagram illustrating the modules and functionality of the modeling module of one embodiment of the clothing design system.
Figure 8:
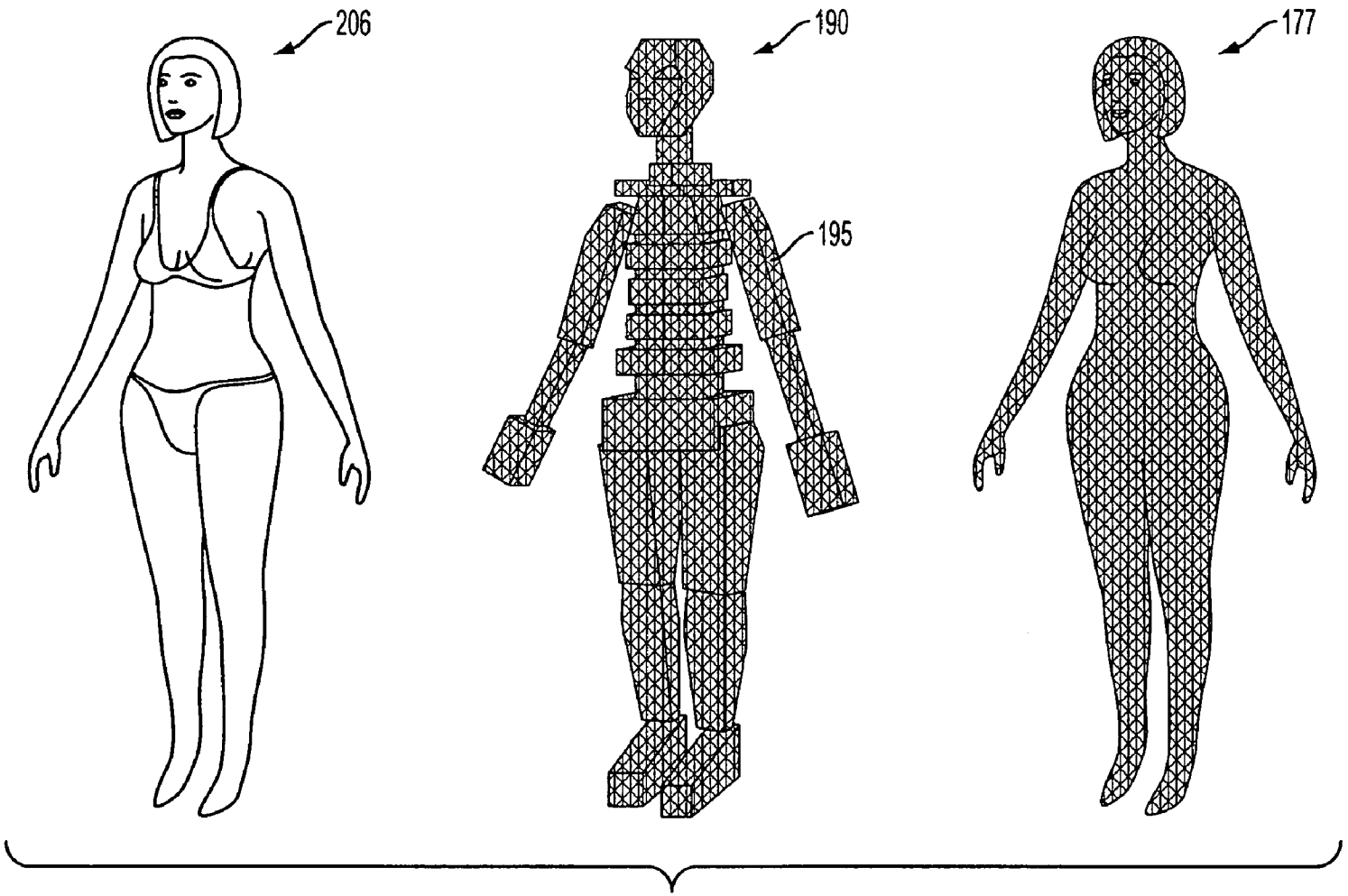
FIG. 8 is a side perspective view illustrating one example of the actual appearance of an intended wearer, the theoretical model applicable to such wearer, and the model generated for such wearer by one embodiment of the clothing design system.

Referring to FIGS. 7 and 8, the modeling module 30, in one embodiment, includes a vector graphics system or a vector modeling system which enables the server 12 to generate a three-dimensional model of the intended wearer. This model of the wearer will, at times, be referred to herein as the generated model 177. In this type of system, a vector data is used to represent discrete features that are defined as points, lines and polygons. In one embodiment, the vector data represents these features as pairs or sets of X, Y, and Z coordinates, and each coordinate set specifies an element, as described below. Each element can be described by a mathematical matrix. Accordingly, the surface of a person's body can be described by a layer of matrices, and a garment can be described by another layer of matrices. As such, the vector-based modeling module 30 can enable the server 12 to generate a model of a person wearing a garment through the use of multi-layered matrices.

In one embodiment, this vector-based modeling module 30 includes: (a) a scalar data module 178 which enables the server 12 to manage and process the scalar data received by the user through use of the wearer characteristic input module 28; (b) an error response module 179 which enables the server 12 to detect whether any portion of the wearer characteristic input data does not meet designated criteria and replace the detected characteristic input data with designated data corresponding to an industry standard; (c) a theoretical or pre-stored model module 180 which enables the server 12 to access a plurality of data sets stored in the database 14 which are associated with different, predetermined, generic or theoretical body models; (d) an interpolation module 182 which enables the server 12 to interpolate a plurality of data points, data coordinates or data values based upon the data associated with the pre-stored models and the data input by the user through use of the wearer characteristic input module 28; (e) a three-dimensional image rendering module 184 which enables the server 12 to convert or transform the vector data into bitmap or pixel data which is displayable by the display device of the computer 18; and (f) an animation module 186 which enables the server 12 to animate the generated model 177.

In the example illustrated in FIG. 7, the pre-stored model module 180 enables the server 12 to access and process a data set associated with a theoretical male model 188, and the pre-stored model module 180 enables the server 12 to access and process a data set associated with a theoretical female model 190. These data sets are stored within the database 14.

The theoretical models 188 and 190 include a plurality of elements 192 and 194, respectively. Each such element is associated with a plurality of coordinate points or coordinate values, such as an X coordinate value, a Y coordinate value and a Z coordinate value. These elements 195 define a meshwork which is the basis for the body surface of the theoretical models 188 and 190. The generic or theoretical data used to create these models 188 and 190 can be derived from a plurality of sources, including, without limitation: (a) ASTM International; and (b) survey or response data collected or derived through questions, forms or surveys presented to one or more populations, people, organizations or other entities. It should be appreciated that the pre-stored model module 180 can include data sets associated with an array of theoretical models, such as a model associated with individuals of different ages or different ranges of height, body weight, size or skeletal structure.

In the example illustrated in FIG. 8, each element 195 has a designated triangular shape. It should be appreciated, however, that any suitable shape can be used, including, without limitation, triangular, square, rectangular or any suitable polygon or geometry.

Referring back to FIG. 7, the interpolation module 182 includes a plurality of interpolation algorithms usable by the server 12 to interpolate data points or data values based on the measurement data input by the user and the data sets associated with the theoretical models. As a result, the interpolation module 182 enables the server 12 to produce a customized male model 198 which would represent the generated model if the wearer were a male, and the interpolation module 182 enables the server 12 to produce a customized female model 200 which would represent the generated model if the wearer were a female, such as the generated model 177 illustrated in FIGS. 1 and 8.

As illustrated in FIG. 7, the interpolation module 182 makes certain changes or modifications to the elements of the theoretical models. These modifications are based on a set of designated interpolation algorithms. The interpolation algorithms enable the server 12 to transform elements 192 and elements 202 to correspond to the unique body characteristics input by the user. As illustrated in FIG. 7, the $Y_2$, $X_4$, $X_2$, and $Z_3$ values of the transformed elements 202 indicate that the server 12 has modified, estimated or interpolated certain coordinate values to generate the customized male model 199. Likewise, the $X_4$, $Y_3$, $X_2$ and two $Z_2$ values of the transformed elements 204 indicate that the server 12 has modified, estimated or interpolated certain coordinate values to generate the customized female model 201.

In operation of one example, the intended wearer is a female with the actual appearance 206 illustrated in FIG. 8. It should be understood that the actual appearance 206 is shown in FIG. 8 only for purposes of describing the modeling function of system 10. The clothing design system 10 can perform all of the functions described herein without requiring any photos or scanning of the intended wearer.

Continuing with this example, the system 10 retrieves the data set associated with the theoretical female model 190 for modeling purposes. Using the wearer characteristic data input by the user, the interpolation module 182 causes the server 12 to perform an interpolation process which results in the generated model 177 illustrated in FIGS. 1 and 8.

In one embodiment, the database 14 stores a plurality of vector data sets associated with a plurality of different types, styles and sizes of garments. Accordingly, both the selected garment and the generated model 177 are vector-based. As such, the interface module 196 enables the computer 18 to display the garment piece images 27 on the generated model 177. In particular, the interface module 196 enables the server 12 to mathematically and graphically interface the garment piece images 27 with the generated model 177.

The interface module 196, in one embodiment, includes a collision module 208. The collision module 208 enables the server 12 to mathematically and graphically attach the garment piece images 27 to designated attachment points of the generated model 177. In addition, the collision module 208 is coupled to the fitting module 32, described below. Based on the user's ease and fit inputs, the collision module 208 enables the server 12 to adjust the spatial relationship between the garment piece images 27 and the generated model 177.

Figure 9:
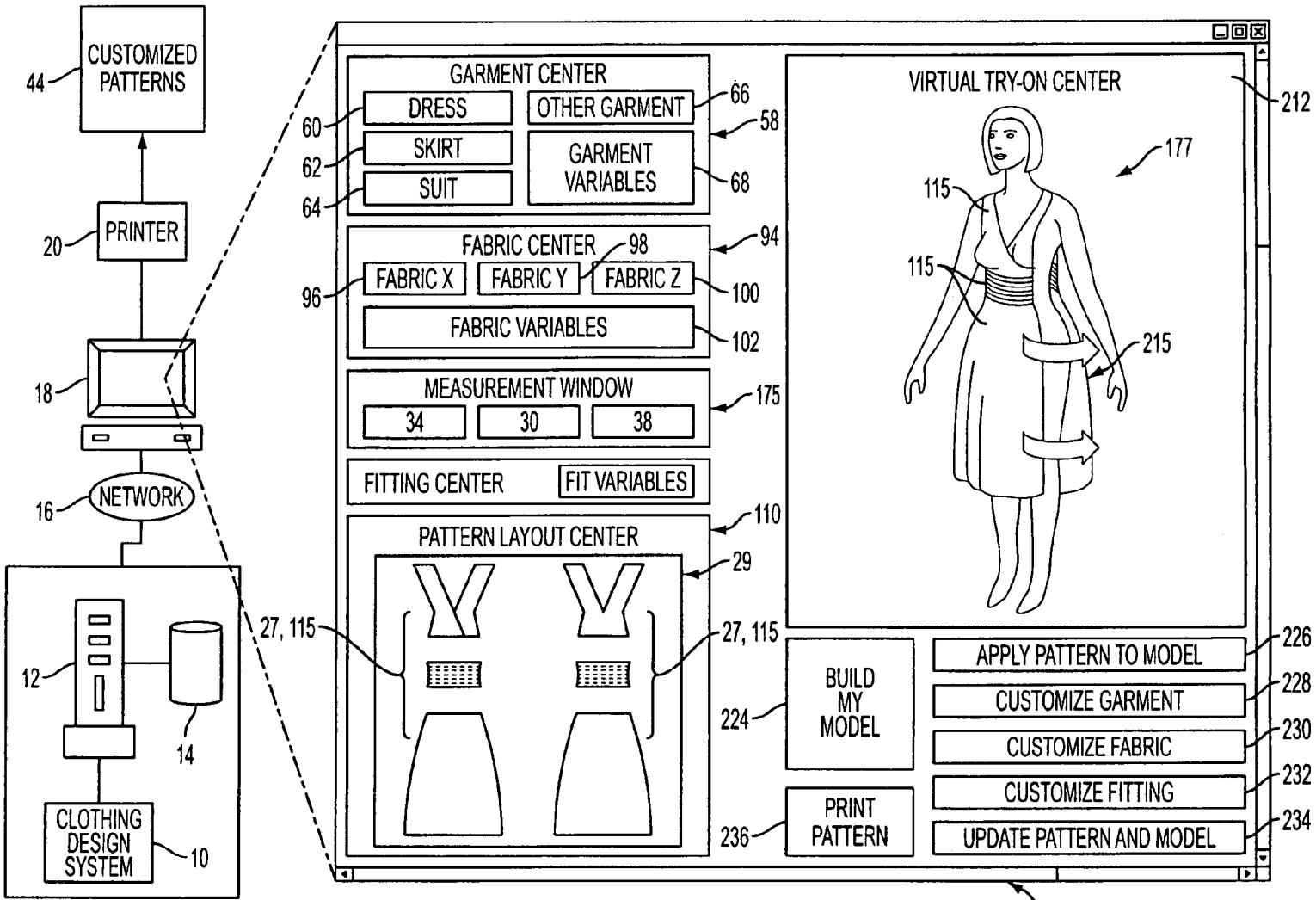
FIG. 9 is a top plan view of a graphical user interface of one embodiment of the clothing design system, illustrating the pattern-shaped garment pieces being dynamically wrapped around the generated model.

Referring back to FIG. 7, the animation module 186 is used by the server 12 to generate a video or any other suitable animation of the generated model 177. In one embodiment, the animation module 186 enables the server 12 to simulate the wrapping of the garment piece images 27 around the generated model 177. In another embodiment, the animation module 186 enables the server 12 to cause the generated model 177 to change stances, move his or her arms or have other body motion while the garment piece images 27 are being worn on the generated model 177. In the example illustrated in FIG. 9, the server 12, under control of the animation module 186, is simulating the garment piece images 27 being wrapped around the generated model 177. In one embodiment, the modeling module 30 enables the user to rotate the generated model 177 through three hundred sixty degrees so the user can view the front, sides and back of the model, and the modeling module 30 also enables the user to view the generated model 177 from a plurality of different viewing angles.

Figure 11:
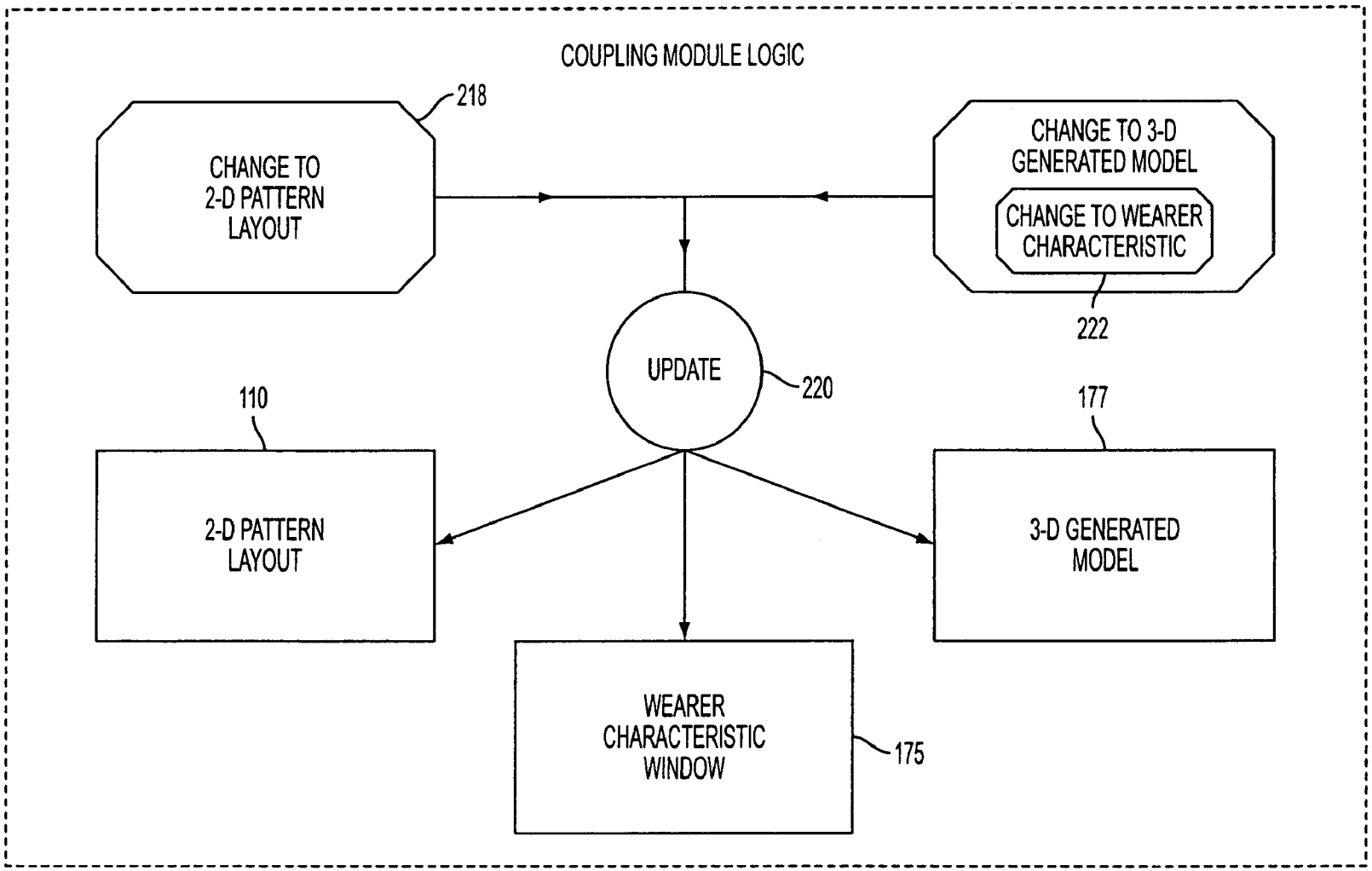
FIG. 11 is a diagrammatic flow diagram illustrating the update operation of the coupling module of one embodiment of the clothing design system.

Referring to FIGS. 1, 10 and 11, the linkage or coupling module 34 links the changes made in the virtual try-on center 212 to the changes made in the pattern layout center 110 and the characteristic window 175. In the example illustrated, the user initially selected the sleeveless dress 214 illustrated in FIG. 1, and the user initially input measurements of thirty-four inches, thirty inches and thirty-eight inches corresponding to bust, waist and hip measurements, respectively. Next, the user customized the sleeveless dress 214 by adding shoulder pieces 215, and the user also updated the bust, waist and hip measurements to thirty-five inches, thirty-one inches and thirty-nine inches, respectively. This resulted in the sleeved dress 216 illustrated in FIG. 10, and this also resulted in the updated measurements shown in the characteristic window 175. After the user made the measurement changes and added the shoulder pieces 215 to the generated model 177, the coupling module 34 caused the shoulder pieces 215 to automatically appear in the pattern layout center 110. At the same time, the coupling module 34 updated the measurements in the characteristic window 175. In addition, the coupling module 34, in conjunction with the layout module 24, caused the server 12 to automatically update the pattern dimensions based on the measurement changes and shoulder piece additions. It should be appreciated that the same type of process can operate in reverse order. For example, if the user adds shoulder pieces 215 to the pattern layout center 110, the coupling module 34 can cause the server 12 to automatically update the generated model 177 with the newly added shoulder pieces 215.

It should also be appreciated that the coupling module 34 can cause the pattern layout center 110 and characteristic window 175 to automatically reflect any suitable change made in the virtual try-on center 212. Likewise, the coupling module 34 can cause the virtual try-on center 212 to automatically reflect any suitable change made in the pattern layout center 110. In one embodiment, for example, if the user changes a body characteristic, such as the dimension of the waist girth 136, the clothing design system 10 can automatically update the characteristic window 175 and the generated model 177, including the size and shape of the garment pieces 115 worn on the generated model 177. In addition, the clothing design system 10 can automatically update the pattern layout center 110 to indicate the change in the dimension of the pattern pieces to reflect the changes in the waist girth measurement.

As illustrated in FIG. 11, the linkage or coupling module 34 facilitates the iterative clothing design process by enabling the user to visualize interactive changes in a virtual try-on environment, while automatically transmitting those changes to the pattern layout and the characteristic window. In operation of one example, the user makes a change to the two-dimensional pattern layout 110, as indicated by step 218. As indicated by update step 220, the server 12 uses the coupling module 34 to automatically and simultaneously update the two-dimensional pattern layout 110, the three-dimensional generated model 177 and the garment worn on the generated model. After that, the user changes the hip measurement for the three-dimensional generated model 177, as indicated by step 222. As indicated by update step 220, the server 12 uses the coupling module 34 to automatically and simultaneously update the two-dimensional pattern layout 110, the three-dimensional generated model 177, the garment worn on the generated model and the wearer characteristic window 175.

Depending upon the type of change made, the coupling module 34 can trigger an automatic dual update of the pattern layout 110 and generated model 177, or the coupling module 43 can trigger an automatic tri-update of the characteristic window 175, pattern layout 110 and generated model 177. In one embodiment, the coupling module 34 includes a plurality of designated coupling algorithms which enable the server 12 to perform the update step 220.

As described above, the fitting module 32 of the clothing design system 10 generally enables the user to adjust a plurality of ease and fit settings while the selected garment is shown worn on the generated model 177. These ease and fit settings, which are pre-stored in the database 14, can include, without limitation, a drape variable, a looseness variable, a tightness variable and any other suitable fit variable.

As described above, the archive module 37 of the clothing design system 10 enables the user to store information in the database 14 for later use. This information can include patterns that the user has set-up, garment types designed by the user, fabric settings that the user has established, a plurality of generated models built by the user, online account information and other suitable files and information.

The preference setting module 40 of the clothing design system 10 enables the user to set and control a plurality of operating parameters for the system 10. In one embodiment, the preference setting module 40 enables the user to set the user's preferences relating to the clothing design or garment design process. Such preferences can include, without limitation, personal profile settings for the generated model, such as hair color, sex or skin tone. In addition, the preference setting module 40 enables the user to set a plurality of system preferences including, without limitation, font type, display settings, sound settings, color scheme settings and other configurable parameters.

The printing module 42 of the clothing design system 10 enables the server 12 to cause the printer 20 to print customized patterns 34 using a standard printer driver or any other suitable printer driver. In one embodiment, the printer module 42 includes a print preview module which enables the user to preview the patterns 44 as laid out on printing paper before actually printing the patterns 44. The printing module 42 also enables the user to select the paper size and type from a plurality of paper settings, including, without limitation, eight and one-half inch by eleven inch sized paper or A4 sized paper sized paper, each of which is suitable for personal computer printers. The paper settings can also enable the user to print patterns 44 on larger paper suitable for commercial-based or industrial-based pattern printing systems. In either case, the print preview function of the printing module 42 enables the user to position the patterns on one or more sheet images so as to minimize or reduce the amount of paper necessary to print a customized pattern 44. In addition, the printing module 42 includes a plotting tool which facilitates the plotting of the pattern images on the paper.

Referring back to FIG. 1, the clothing design system 10, in one embodiment, provides the user with access to a database and a graphical user interface which enables the user to: (a) select the desired garment to be made; (b) select the desired fabric for the garment; (c) lay the pattern over the fabric on a virtual table 110; (d) activate the build-my-model input 224 to build a three-dimensional generated model 177 of the intended wearer based upon body characteristics entered by the user using a keyboard, touch screen or other suitable input device; (e) apply the pattern to the generated model 177 by activating the apply input 226, resulting in a simulation of the patterned garment being wrapped around the generated model 177; (f) activate the customize garment input 228 to make adjustments to the garment or body size or shape of the generated model 177; (g) activate the customize fabric input 230 to make adjustments to the fabric type of fabric; (h) activate the customize fitting input 232 to make adjustments to ease and fit variables of the garment worn on the generated model 177; (i) activate the update input 234 to view an update of the pattern layout and measurement window which the server 12 automatically generates based upon changes made in the virtual try-on center 212; and (j) activate the print pattern input 236 to print the customized patterns 44 necessary to make the garment as viewed on the three-dimensional generated model 177. This type of system provides users with enhanced convenience, efficiency and customization in designing garments and generating garment patterns.

In one alternative embodiment, the structure and functionality of system 10 is applicable to the design of upholstery for furniture (such as slip covers), window treatments (such as drapes), accessories (such as pillows), home decoration items and other fabric devices or fabric items which are designable through the use of templates or patterns. The term fabric item, as used below, will be a general reference to any one of these types of pattern-based fabric devices or items. In this embodiment, the pattern-based design system includes the structure, components and functionality of the clothing design system 10 described above, except that: (a) the garment is replaced with the particular fabric item being designed (such as a slip cover for a sofa); (b) the garment module 22 is replaced with a fabric item module (such as a slip cover module); (c) the generated model 177 is a generated model of the structure (such as a sofa) which will support a corresponding fabric item; (d) the wearer characteristic input module 28 is operable to receive characteristics (such as, sofa height, width and depth) associated with the structure that will carry the fabric item; and (e) the modeling module 30 is operable to enable the server 12 to generate a three dimensional graphical model of such structure based upon: (i) pre-stored data associated with such type of structure; and (ii) the measurement and characteristic inputs provided by the user.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A data storage device having stored thereon a plurality of computer-readable instructions executable to:

(a) process garment data, the garment data including data representing characteristics of a plurality of different types of garments, each one of the garments having at least one garment piece, each garment piece having a shape which is specifiable in a single plane by a pattern;

(b) cause a display of a first image, the first image illustrating at least one of the patterns;

(c) receive a plurality of first inputs, the first inputs corresponding to a plurality of body characteristics of a possible wearer;

(d) create a second image based on a plurality of calculations of an interpolation process using the plurality of first inputs, at least one theoretical model measurement, and at least one actual measurement specific to the possible wearer, the plurality of calculations resulting in a plurality of interpolated data points representing at least two points between at least two different geometric objects, the second image including:

(i) a graphical model of the possible wearer, the graphical model being based, at least in part, on the plurality of interpolated data points; and (ii) a representation of at least one of the garment pieces worn on the graphical model based, at least in part, on the plurality of interpolated data points;

(e) cause a display of the second image;

(f) receive at least one second input, the second input corresponding to at least one garment characteristic;

(g) change the first image in response to the second input; and (h) change the second image in response to the second input.

2. The data storage device of claim 1, wherein the first image has a two-dimensional appearance.

3. The data storage device of claim 1, wherein the graphical model has a three-dimensional appearance.

4. The data storage device of claim 3, wherein at least one garment piece has a three-dimensional appearance when the at least one garment piece is displayed as worn on the graphical model.

5. The data storage device of claim 1, wherein the first image includes an image illustrating at least one of the patterns.

6. The data storage device of claim 1, having stored thereon a plurality of computer-readable instructions executable to process a plurality of designated model data sets, each one of the designated model data sets representing an appearance of a designated theoretical wearer.

7. The data storage device of claim 6, wherein at least one of the designated model data sets includes data representing an appearance of a male human, and at least one of the designated model data sets includes data representing an appearance of a female human.

8. The data storage device of claim 7, wherein each one of the designated model data sets includes vector data specifying a plurality of elements, each one of the elements including a plurality of designated coordinate points.

9. The data storage device of claim 8, having stored thereon a plurality of computer-readable instructions executable to select a plurality of the designated coordinate points as a result of the first inputs, the selection resulting in a plurality of selected designated coordinate points and a plurality of non-selected designated coordinate points, the interpolation process using the selected designated coordinate points create the graphical model of the second image.

10. The data storage device of claim 9, having stored thereon a plurality of computer-readable instructions executable to use the interpolation process to generate a changed version of a plurality of the non-selected designated coordinate points, the interpolation process using the changed version of the non-selected designated coordinate points to create the graphical model of the second image.

11. A system including at least one processor to facilitate garment design activities, the system comprising:

a garment module executable by the at least one processor to process garment data including a plurality of garment design variables, the garment design variables usable to design at least one garment, the at least one garment being formable by connecting a plurality of garment portions, each one of the garment portions being specifiable in a single plane by a pattern;

a layout module executable by the at least one processor to cause a display of a two-dimensional image of at least one pattern in a layout window;

a wearer characteristic module executable by the at least one processor to receive a plurality of wearer characteristic inputs, the wearer characteristic inputs resulting in wearer characteristic input data which corresponds to a plurality of characteristics of a wearer;

a vector-based modeling module including an interpolation module, the vector-based modeling module and the interpolation module each executable by the at least one processor to:

(a) create a three-dimensional model of the wearer based on:

(i) pre-stored data representing a plurality of characteristics of a theoretical body;

(ii) the wearer characteristic input data; and (iii) interpolation data produced by the at least one processor based on a plurality of calculations of the interpolation process resulting in a plurality of interpolated data points, based on at least one theoretical model measurement, and based on at least one actual measurement specific to the possible wearer, the plurality of interpolated data points representing at least two points between at least two different geometric objects;

(b) cause a display of the three-dimensional model of the wearer; and (c) cause an image representative of the garment portions to be displayed in a connected fashion as at least one garment on the three-dimensional model;

a garment customization module executable by the at least one processor to receive at least one garment customization input, the garment customization input corresponding to at least one of the garment design variables;

a fit adjustment module executable by the at least one processor to receive at least one fit adjustment input, the at least one fit adjustment input corresponding to at least one fit variable;

a coupling module executable by the at least one processor to:

(a) upon receiving the at least one garment customization input:

(i) cause a display of an alteration to at least a portion of the images representative of the garment portions on the three-dimensional model in the model window; and (ii) cause a display of an alteration to the two-dimensional image of at least one of the patterns in the layout window;

(b) upon receiving the at least one fit adjustment input:

(i) cause a display of an alteration to at least a portion of the images representative of the garment portions on the three-dimensional model in the model window; and (ii) cause a display of an alteration to the two-dimensional image of at least one pattern in the layout window; and a wearer preference module executable by the at least one processor to receive data representing a plurality of preferences of the wearer.

12. The system of claim 11, wherein the garment design variables include at least one variable selected from the group consisting of: a garment type, a garment shape, a garment style, a garment color, a fabric parameter, a fabric type, an addition of a designated garment piece to the garment, an adjustment of a garment shape, and an edge adjustment.

13. The system of claim 11, wherein the system includes a fabric module executable by the at least one processor to process fabric data including a plurality of fabric variables, the fabric variables including at least one variable selected from the group consisting of: a color, a pattern, a weight, a grain, a drape, a width, a total length available, a thickness, a bitmap image, a threadcount, and a trade name.

14. The system of claim 11, wherein the layout module includes a fold module executable by the at least one processor to cause at least one fold line to be displayed on the two-dimensional image of at least one pattern.

15. The system of claim 11, wherein the wearer characteristic module includes a prompt module executable by the at least one processor to output a plurality of prompts operable to facilitate the wearer characteristic inputs.

16. The system of claim 11, wherein the wearer characteristic inputs include at least one input selected from the group consisting of: a stature input, a crotch length input, an arm length input, a neck girth input, a chest girth input, an underbust girth input, a waist girth input, and a hip girth input.

17. The system of claim 11, wherein the wearer includes a subject selected from the group consisting of: a human, an actual person, a theoretical person, and an animal.

18. The system of claim 11, wherein a plurality of the wearer characteristic inputs correspond to a plurality of surface shapes of a plurality of bodily portions of the wearer.

19. The system of claim 11, wherein the vector-based modeling module includes an error response module executable by the at least one processor to: (a) detect whether any portion of the wearer characteristic input data meets at least one designated criterion; and (b) if any portion of the wearer characteristic input data does not meet the at least one designated criterion, replace that portion of the wearer characteristic input data with designated data corresponding to an industry standard.

20. The system of claim 19, wherein the vector-based modeling module includes an animation module, and wherein causing a display of the three-dimensional model includes causing a display of an animation.

21. The system of claim 20, wherein the animation includes a video display of the garment being dynamically wrapped around the three-dimensional model of the wearer.

22. The system of claim 11, wherein the vector-based modeling module includes a viewing angle module executable by the at least one processor to display the three-dimensional model of the wearer from a plurality of different angles.

23. The system of claim 11, wherein the vector-based modeling module includes a collision module executable by the at least one processor to couple the images representative of the garment portions to the three-dimensional model.

24. The system of claim 11, wherein the fit variable includes a variable selected from the group consisting of: a drape variable, a looseness variable, and a tightness variable.

25. The system of claim 11, wherein the preferences of the wearer include at least one preference selected from the group consisting of: a skin tone, a hair color, a graphical user interface preference, a font type, a default measurement, and a fit variable.

26. The system of claim 11, which includes a pattern printing module executable by the at least one processor to: (a) cause a display of an image illustrating one or more print pages; (b) determine a quantity of the print pages necessary to construct a printing of all of the patterns; (c) cause the two-dimensional images of the patterns to be displayed on the determined quantity of print pages; and (d) cause the two-dimensional images of the patterns to be printed on the determined quantity of print pages.

27. The system of claim 11, which includes a fabric usage optimizer module executable by the at least one processor to automatically select a width and length dimension for a fabric piece sized at least as large as at least one pattern in laid-out form, wherein the selected width and length dimension reduces a total area of the fabric piece which will be unused in constructing the garment.

28. The system of claim 11, which include an archive module executable by the at least one processor to store and retrieve: (a) the two-dimensional images of a plurality of the patterns; (b) the images of a plurality of the garment portions; and (c) the three-dimensional model.

29. The system of claim 11, which includes a fabric module executable by the at least one processor to: (a) access data corresponding to a plurality of different fabrics; and (b) display an image indicative of each one of the fabrics.

30. A computerized method for facilitating garment design activities, the method comprising:

accessing garment data, the garment data including data representing a plurality of characteristics of a plurality of different types of garments, each one of the garments having at least one garment piece, each garment piece having a shape which is specifiable in a single plane by a pattern;

causing a display of a first image, the first image illustrating at least one of the patterns;

receiving a plurality of first inputs, the first inputs corresponding to a plurality of body characteristics of a possible wearer;

generating a second image based on a plurality of calculations of an interpolation process using the plurality of first inputs, at least one theoretical model measurement, and at least one actual measurement specific to the possible wearer, to result in a plurality of interpolated data points, the plurality of interpolated data points representing at least two points between at least two different geometric objects, the second image including:

(i) a graphical model of the possible wearer, the graphical model being based, at least in part, on the plurality of interpolated data points; and (ii) a representation of at least one of the garment pieces worn on the graphical model based, at least in part, on the plurality of interpolated data points;

causing a display of the second image;

receiving at least one second input, the second input corresponding to at least one garment characteristic;

changing the first image in response to the second input; and changing the second image in response to the second input.

31. The computerized method of claim 30, which includes causing the first image to have a two-dimensional appearance.

32. The computerized method of claim 31, which includes causing the graphical model of the second image to have a three-dimensional appearance.

33. The computerized method of claim 32, which includes causing the first image to appear to be wrapped around the graphical model.

34. The computerized method of claim 30, which includes accessing a plurality of designated model data sets, wherein: (a) each one of the designated model data sets represents a structure of a designated theoretical wearer; (b) at least one of the designated model data sets represents a theoretical male wearer; (c) at least one of the designated model data sets represents a theoretical female wearer; (d) each one of the designated model data sets includes vector data specifying a plurality of elements; and (e) each one of the elements is associated with a plurality of designated coordinate values.

35. The computerized method of claim 34, which includes: (a) selecting a plurality of the designated coordinate values which correspond to values resulting from the first inputs, the selection resulting in a plurality of selected designated coordinate values and a plurality of non-selected designated coordinate values; (b) using the selected designated coordinate values to produce the graphical model; (c) performing the plurality of calculations on at least two of the non-selected designated coordinate values; and (d) using an output of the plurality of calculations to produce the graphical model.

36. A data storage device having stored thereon a plurality of computer-readable instructions executable to:

(a) process garment data, the garment data including data representing characteristics of a plurality of different types of garments, each one of the garments having at least one garment piece, each garment piece having a shape which is specifiable in a single plane by a pattern;

(b) cause a display of a first image, the first image illustrating at least one of the patterns;

(c) receive a plurality of first inputs, the first inputs corresponding to a plurality of body characteristics of a possible wearer;

(d) detect whether any of the plurality of first inputs do not meet a plurality of designated criteria;

(e) if any of the plurality of first inputs do not meet the plurality of designated criteria, replace the body characteristics corresponding to such detected first inputs with designated data;

(f) create a second image based on a plurality of calculations of an interpolation process using the plurality of first inputs, at least one theoretical model measurement, and at least one actual measurement specific to the possible wearer, the plurality of calculations resulting in a plurality of interpolated data points representative of the possible wearer, the plurality of interpolated data points representing at least two points between at least two different geometric objects, the second image including:

(i) a graphical model of the possible wearer, the graphical model being based, at least in part, on the plurality of interpolated data points and on any designated data that replaced any of the plurality of first inputs; and (ii) a representation of at least one of the garment pieces worn on the graphical model based, at least in part, on the plurality of interpolated data points and on any designated data that replaced any of the plurality of first inputs;

(g) cause a display of the second image;

(h) receive at least one second input, the second input corresponding to at least one garment characteristic;

(i) change the first image in response to the second input; and (j) change the second image in response to the second input.

37. The data storage device of claim 36, wherein the first image has a two-dimensional appearance.

38. The data storage device of claim 36, wherein the graphical model has a three-dimensional appearance.

39. The data storage device of claim 38, wherein at least one garment piece has a three-dimensional appearance when the at least one garment piece of said at least one garment is displayed as worn on the graphical model.

40. The data storage device of claim 36, wherein the first image includes an image illustrating at least one of the patterns.

41. The data storage device of claim 36, wherein the designated data corresponds to at least one industry standard.

42. A system including by at least one processor to facilitate garment design activities, the system comprising:

a garment module executable by the at least one processor to process garment data including a plurality of garment design variables, the garment design variables usable to design at least one garment, the at least one garment being formable by connecting a plurality of garment portions, each one of the garment portions being specifiable in a single plane by a pattern;

a layout module executable usable-by the at least one processor to cause a display a two-dimensional image of at least one pattern in a layout window;

a wearer characteristic module executable by the at least one processor to receive a plurality of wearer characteristic inputs, the wearer characteristic inputs resulting in wearer characteristic input data which corresponds to a plurality of characteristics of a wearer;

a vector-based modeling module having:

(a) an error response module executable by the at least one processor to:

(i) detect whether any portion of the wearer characteristic input data does not meet a plurality of designated criteria; and (ii) if any portion of the wearer characteristic input data does not meet the plurality of designated criteria, replace any such portion of the wearer characteristic input data with designated data; and (b) an interpolation module executable by the at least one processor to:

(i) create a three-dimensional model of the wearer based on:

(x) pre-stored data representing a plurality of characteristics of a theoretical body;

(y) the wearer characteristic input data; and (z) interpolation data produced by the at least one processor based on a plurality of calculations of the interpolation process resulting in a plurality of interpolated data points, based on at least one theoretical model measurement, and based on at least one actual measurement specific to the possible wearer, the plurality of interpolated data points representing at least two points between at least two different geometric objects;

(ii) cause a display of the three-dimensional model of the wearer; and (iii) cause an image representative of the garment portions to be displayed in a connected fashion as at least one garment on the three-dimensional model;

a garment customization module executable by the at least one processor to receive at least one garment customization input, the garment customization input corresponding to at least one of the garment design variables;

a fit adjustment module executable by the at least one processor to receive at least one fit adjustment input, the at least one fit adjustment input corresponding to at least one fit variable;

a coupling module which is executable by the at least one processor to:

(a) upon receiving the at least one garment customization input:

(i) cause a display of an alteration to at least a portion of the images representative of the garment portions on the three-dimensional model in the model window; and (ii) cause a display of an alteration to the two-dimensional image of at least one pattern in the layout window;

(b) upon receiving the at least one fit adjustment input:

(i) cause a display of an alteration to at least a portion of the images representative of the garment portions on the three-dimensional model in the model window; and (ii) cause a display of an alteration to the two-dimensional image of at least one pattern in the layout window; and a wearer preference module executable by the at least one processor to receive data representing a plurality of preferences of the wearer.

43. The system of claim 42, wherein the system includes a fabric module executable by the at least one processor to process fabric data including a plurality of fabric variables, the fabric variables including at least one variable selected from the group consisting of: a color, a pattern, a weight, a grain, a drape, a width, a total length available, a thickness, a bitmap image, a threadcount, and a trade name.

44. The system of claim 42, wherein the designated data corresponds to an industry standard.

45. The system of claim 42, wherein the vector-based modeling module includes an animation module, and wherein causing a display of the three-dimensional model includes causing a display of an animation.

46. The system of claim 42, which includes a pattern printing module executable by the at least one processor to: (a) cause a display of an image illustrating one or more print pages; (b) determine a quantity of the print pages necessary to construct a printing of all of the patterns; (c) cause the two-dimensional images of the patterns to be displayed on the determined quantity of print pages; and (d) cause the two-dimensional images of the patterns to be printed on the determined quantity of print pages.

47. The system of claim 42, which includes a fabric usage optimizer module executable by the at least one processor to determine at least one dimension for a fabric piece, the fabric piece being sized at least as large as one of the patterns, the determined dimension being usable to reduce an amount of fabric scrap, and the determined dimension including a dimensional parameter selected from the group consisting of: a width dimension; a length dimension; and a width and length dimension.

48. A computerized method for facilitating garment design activities, the method comprising:

accessing garment data, the garment data including data representing a plurality of characteristics of a plurality of different types of garments, each one of the garments having at least one garment piece, each garment piece having a shape which is specifiable in a single plane by a pattern;

causing a display of a first image, the first image illustrating at least one of the patterns;

receiving a plurality of first inputs, the first inputs corresponding to a plurality of body characteristics of a possible wearer;

detecting whether any of the plurality of first inputs do not meet a plurality of designated criteria, wherein if any of the plurality of first inputs do not meet the plurality of designated criteria, replacing the body characteristics corresponding to any such designated first inputs with designated data;

generating second image based on a plurality of calculations of an interpolation process using the plurality of first inputs, at least one theoretical model measurement, and at least one actual measurement specific to the possible wearer, to result in a plurality of interpolated data points, the plurality of interpolated data points representing at least two points between at least two different geometric objects, the second image including:

(i) a graphical model of the possible wearer, the graphical model being based, at least in part, on the plurality of interpolated data points; and (ii) a representation of at least one of the garment pieces worn on the graphical model based, at least in part, on the plurality of interpolated data points;

causing a display of the second image;

receiving at least one second input, the second input corresponding to at least one garment characteristic;

changing the first image in response to the second input; and changing the second image in response to the second input.

49. The computerized method of claim 48, which includes causing the first image to have a two-dimensional appearance.

50. The computerized method of claim 49, which includes causing the graphical model to have a three-dimensional appearance.

51. The computerized method of claim 48, which includes replacing the body characteristics corresponding to any of the detected first inputs which do not meet the plurality of designated criteria with designated data corresponding to an industry standard.

52. The computerized method of claim 48, which includes accessing a plurality of designated model data sets, wherein: (a) each one of the designated model data sets represents a structure of a designated theoretical wearer; (b) at least one of the designated model data sets represents a theoretical male wearer; (c) at least one of the designated model data sets represents a theoretical female wearer; (d) each one of the designated model data sets includes vector data specifying a plurality of elements; and (e) each one of the elements is associated with a plurality of designated coordinate values.

53. The computerized method of claim 52, which includes: (a) selecting a plurality of the designated coordinate values which correspond to values resulting from the first inputs, the selection resulting in a plurality of selected designated coordinate values and a plurality of non-selected designated coordinate values; (b) using the selected designated coordinate values to produce the graphical model; (c) performing the plurality of calculations on at least two of the non-selected designated coordinate values; and (d) using an output of the plurality of calculations to produce the graphical model.

* * * * *